United States Patent [19]

Eitel

[11] Patent Number: 4,923,180

[45] Date of Patent: May 8, 1990

[54] PROCESS AND APPARATUS FOR RESTORING THE LINING OF METALLURGICAL LADLES

[75] Inventor: Wilhelm Eitel, Ratingen, Fed. Rep. of Germany

[73] Assignee: Intocast GmbH Feuerfestprodukte und Giesshilfsmittel, Ratingen, Fed. Rep. of Germany

[21] Appl. No.: 245,219

[22] Filed: Sep. 16, 1988

[30] Foreign Application Priority Data

Dec. 4, 1987 [DE] Fed. Rep. of Germany ..... 3741073

[51] Int. Cl.[5] ..... C21C 5/44

[52] U.S. Cl. ..... 266/44; 266/281; 264/30

[58] Field of Search ..... 266/281, 44, 287; 264/30

[56] References Cited

U.S. PATENT DOCUMENTS

| | | | |
|---|---|---|---|
| 3,944,193 | 3/1976 | Imai et al. | 266/281 |
| 4,328,959 | 5/1982 | Holtmann | 266/281 |

FOREIGN PATENT DOCUMENTS

| | | | |
|---|---|---|---|
| 0040182 | 9/1984 | Japan | 264/30 |
| 2004808 | 1/1987 | Japan | 264/30 |
| 0975201 | 11/1982 | U.S.S.R. | 264/30 |
| 0992121 | 1/1983 | U.S.S.R. | 264/30 |
| 8800322 | 1/1988 | World Int. Prop. O. | 264/30 |

*Primary Examiner*—S. Kastler

*Attorney, Agent, or Firm*—Foley & Lardner, Schwartz, Jeffery, Schwaab, Mack, Blumenthal & Evans

[57] ABSTRACT

A process and an apparatus, by means of which the used surface of the lining of a steel ladle can be worked away, following the contours, in uniform layer thickness. On compliantly displaceable arms, tools are pressed against the inner circumference of the lining which exert a hammering pact against the surface layer of the lining under the effect of a vibrator. Then a mold is lowered into the ladle and the space remaining between the mold and the worked-away inner surface is filled with a pourable, refractory material, which bonds with the old lining to form a new monolithic lining.

28 Claims, 2 Drawing Sheets

PROCESS AND APPARATUS FOR RESTORING THE LINING OF METALLURGICAL LADLES

BACKGROUND OF THE INVENTION

1. Field of the Invention

The invention relates to a process for restoring the refractory lining of metallurgical ladles and to an apparatus suitable for implementation of the process.

2. Related Art

The process of the generic type is known from a paper presented by T. Mafune and M. Chastant during their Journees d'Information Techniques de Mise en Oeuvre des Produits & Materiaux Refractaires on Oct. 29th and 30th 1985, in Nancy, France. The necessity after a series of melt charges to remove the outer skin of the lining, also known as the "skull", exposed to the melt, is only mentioned there without specifying the details of practical implementation. The "skull" consists of the adhering layer of slag and the uppermost layer of the old lining into which slag and melt have penetrated superficially. The removal is necessary in order to ensure a satisfactory bond of the newly introduced refractory material with the parts of the old lining which have remained in place and to restore a compact, resistant, monolithic lining of the ladle.

SUMMARY AND OBJECTS OF THE INVENTION

The invention is based on the object of creating a process and apparatus by means of which the removal of the uppermost layers of the refractory lining can be carried out quickly and economically before introducing the new refractory material.

A lining which has been in operation hardly ever wears completely uniformly. Even if the initial inner cross-section may have been circular, after a series of melt charges an irregular surface shape is produced due to the extremely varied effects. An essential feature of the invention is that the working-away of the surface layers to be removed of the lining does not take place in the manner of a turning-out, after which again a substantially cylindrical inner circumferential shape of the lining would be produced. In this case, the working-away would have to go down as far as the lowermost depressions of the lining occurring in operation and large quantities of lining which is in fact still serviceable would have to be worked away and discarded, which would mean considerable losses of the lining material. In the case of the invention, on the other hand, the working-away follows the contours, ie. only a layer which has been penetrated with slag or melt is worked away from the surface, without inevitably producing a cylindrical inner circumferential surface. Only the unusable portion is removed, but still usable portions at a certain depth remain, disregarding the inner circumferential shape of the cleaned lining. Since only limited quantities of the lining material have to be removed, the treatment of the surface of the old lining is relatively quick.

The preferred embodiment, by means of which a gentle removal of the used surface layer of the lining down to a limited depth can be brought about, is accomplished by the substantially simultaneous hammering impact of a plurality of crushing elements.

It is known to perform a definite breaking-out on a lining using chisel-like tools. Apart from with manually operated pneumatic hammers, this is carried out with more powerful hammers attached to the boom of equipment which can be moved on crawlers However, this does not involve the removal of a limited layer. This is made possible in the case of the instant invention the use of a plurality of crushing elements, which arrangement does not involve a single chisel-like element penetrating deeply, but the lining only being crushed superficially over an area and removed to a limited, quite uniform depth.

The apparatus for the implementation of the process is configured such that the contour-following removal is ensured by the compliant displaceability of arms, as a result of which the tool can follow the surface shape of the lining and is capable of performing its attack only in layers, even in the case of an undulating wall surface.

In the case of the preferred embodiment the arms are arranged substantially tangential to an imaginary circle around the ladle axis. The substantially tangential alignment of the arms, together with the towed arrangement, makes possible a particularly good following movement with regard to the relief of the lining.

If an arm is mounted on a retaining piece which can be swung up and down, the tool can also work the bottom of the ladle.

A controllably compliant contact of the tool on the surface of the lining and at the same time the movement of the arm can be brought about by relays operated by a fluid pressure medium which may be designed as pneumatic or hydraulic piston/cylinder units.

The interposing of a damping element on the one hand enhances the compliance of the contact of the tools, and on the other hand prevents an excessive transfer of the vibrations to the piston/cylinder units.

In the preferred embodiments, the tool is designed as a rotatably mounted disk arrangement which bears chisel-like crushing elements on the periphery.

When the arms rotate, the disk arrangement rolls on the surface of the lining with a hammering action. Consequently, the tool cannot be caught up and the tearing-out of large pieces, possibly with still usable portions of the lining, is avoided.

The capability of the tools to follow the unevennesses of the wall without being caught up is increased still further by the bearing of the tools about an axis disposed in the swivel plane of the arms. As a result, they can move and adapt themselves in the manner of guide rollers.

The disk arrangement may comprise a plurality of disks arranged coaxially next to one another with their crushing elements designed as flatly pointed chisel-like studs around the periphery.

If one disk is slightly larger than the neighboring disk, the vibrational forces act preferably on the crushing elements of the disk. An accessibly deep penetration is prevented however by the fact that, after a penetration distance corresponding to the difference in radius, the disk arrangement comes into contact with the crushing elements of the other disk on the surface of the lining and a further penetration is retarded by the distribution of vibrational forces over a plurality of crushing elements.

The vibrator is expediently arranged such that it can act directly on the tool, but does not stand in the way.

In order to be able to lower the apparatus into the ladle, a vertical guide is recommended. The vertical guide can, for its part, be supported in a way which takes on a special meaning in the system, the most important feature of which is the exchangeability of the apparatus for the mold required during the introduction of the refractory material, on the same stand arranged around the base of the ladle.

BRIEF DESCRIPTION OF THE DRAWINGS

Exemplary embodiments of the invention are presented in the drawings, wherein.

DETAILED DESCRIPTION OF THE PREFERRED EMBODIMENTS

Figure 1:
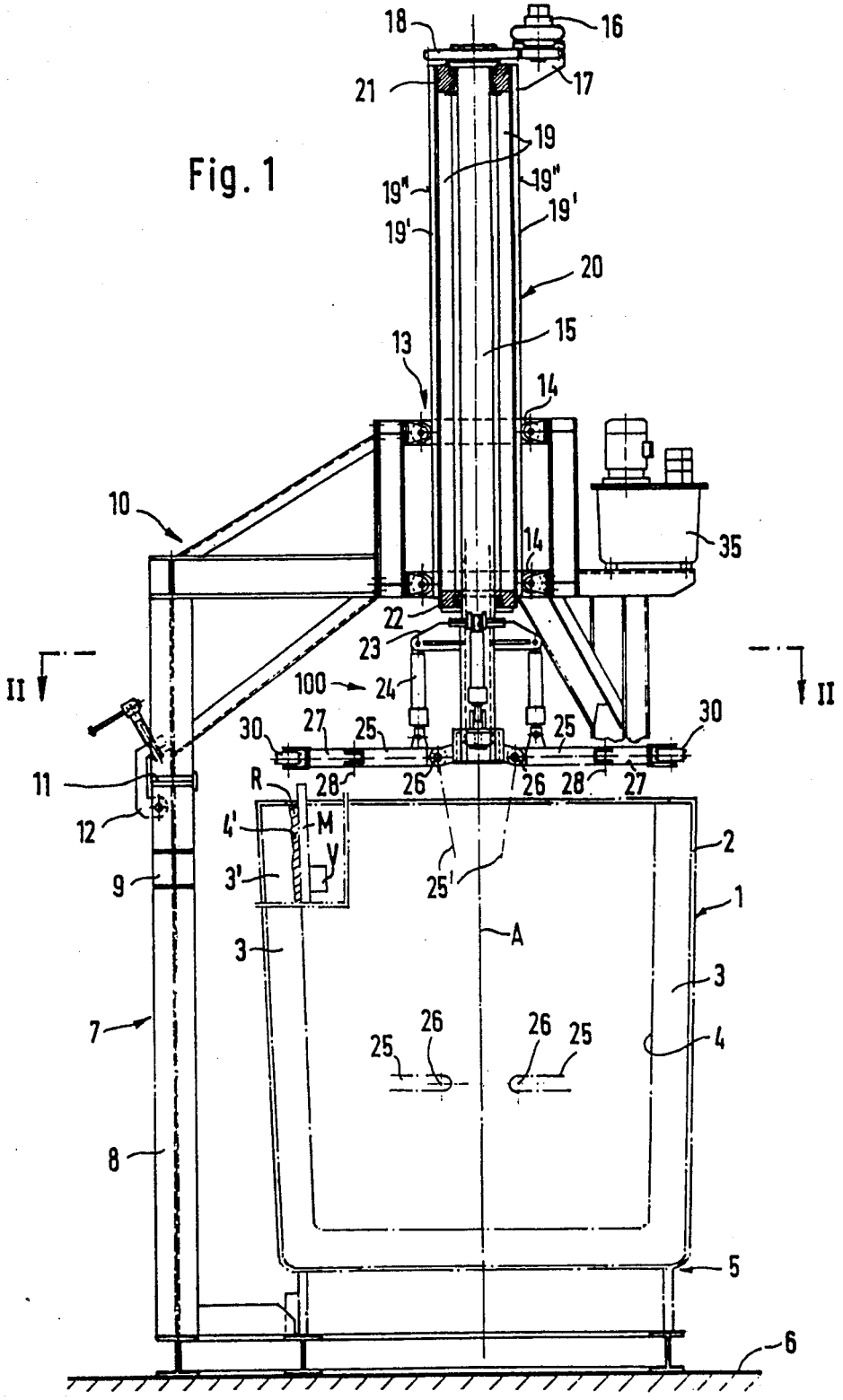
FIG. 1 is a side view of the apparatus according to the invention, partially in section.

The apparatus denoted as a whole by 100 in FIG. 1 serves as an auxiliary tool for restoring the metallurgical ladle which in the exemplary embodiment is a large ladle for use in steel making. The ladle 1 comprises a container 2 of thick sheet steel, which has on the inside a refractory lining 3, the inner surface 4 of which displays the effects of wear after a certain number of steel melt charges and has to be restored. This takes place by a mold corresponding to the desired ladle cavity being lowered into the ladle and the intermediate space between the mold and the worn surface 4 being filled with a pourable refractory material, which can be fluidized and compacted by vibrations. In the case of the preferred exemplary embodiment, refractory materials having thixotropic properties are used, because in this case, only moisture contents of 4% to 5% are necessary, which of course speeds up the drying of the compacted material before the ladle is put back into use.

In order that a satisfactory bond of the newly applied refractory material with the underlying "old" lining then comes about, the surface of the old lining has to be removed, because remains of slag adhere to it and the surface has also been penetrated to a certain depth by molten slag and melt. Applying new refractory material to such a surface would result in an inadequate adhesion and would also adversely affect the refractory properties of the lining.

The aim in that the working-away of the lining 3 is to retain as much as possible of the still usable, deeper-lying areas of the lining and really to remove only the unusable portions of the surface. However, the problem is that experience shows that the inner surface 4 does not wear uniformly, but after a series of steel melt charges becomes undulating. This is particularly caused by the different erosion effects of the steel jet during the filling of the steel and generally due to the local turbulences in the bath. If working-away were then to be performed in such a way that a uniform shape of the inner surface 4 were created, the lining 3 would have to be removed everywhere down to a depth which corresponds to the most worn place. Consequently, much of the refractory material would also be removed from the less worn places, which is in fact still usable.

Working-away is thus to take place in such a way that only a substantially uniform layer is removed, the surface relief being retained substantially. Such a working-away of the surface layers which have become unusable is accomplished with the apparatus 100.

The ladle 1 is placed by a crane on a base indicated at 5 on the shop floor 6. Around the base 5 there is provided a stand, denoted as a whole by 7, which in the exemplary embodiment comprises upright columns 8 which are interconnected in the upper region by cross brackets 9. The columns 8 have, at their upper ends, locating surfaces 11, onto which a guide framework, denoted as a whole by 10, with corresponding locating surfaces, can be placed and locked with the aid of clamping devices 12.

On the guide framework 10 there is provided a vertical guide 13 with pairs of rollers 14, arranged one above the other, which are distributed around the circumference and at which a carrier, denoted as a whole by 20, can be raised and lowered by a device which is not shown. The carrier 20, the length of which is determined by the maximum depth occurring in the ladles 1, consists of two U-profiles 19, the open sides facing each other. On the backs of which profiles rectangular profiles 19', extending in the longitudinal direction, are bolted on or welded on and form on their outsides mutually parallel guide surfaces 19'', extending in longitudinal direction of the carrier 20 and intended for the application of the rollers 14. In the carrier 20, on bearings 21, 22 provided at its ends, there is a carrier tube 15 rotatably mounted about an axis A, which tube extends over the entire length of the carrier 20 and projects beyond the latter at the bottom. At the upper end of the carrier 20 there is provided a hydraulic motor 16 which is able to rotate the carrier tube 15 via a gear wheel operation 17,18.

At the end of the carrier tube 15 projecting downward out of the carrier 20 there are provided, just underneath the lower end of the carrier 20, diametrically overhanging holding arms 23, from the outer ends of which hydraulic piston/cylinder units 24 run downward, acting on holding pieces 25, which are capable of being swung in the lower region of the downwardly projecting ends of the carrier tube 15 about axes 26 running in a radial plane, out of the horizontal position reproduced in solid lines in FIG. 1, into a downwardly directed position indicated at 25' in FIG. 1. In the horizontal position, the holding pieces 25 extend substantially radially to the carrier tube 15 and bear at their end the arms 27. The holding pieces are capable of being swivelled about axes 28, perpendicular to the axes 26, in the position shown in FIG. 1 of the holding pieces 25, in other words in a horizontal plane.

The arms 27 do not run radially, but to the longitudinal extent indicated in FIG. 2 by the dot-dashed line 49, tangentially to an imaginary horizontal circle 51 about the axis A, which has in the exemplary embodiment approximately half the diameter of the ladle At their free ends, the arms 27 bear tools 30, which can rotate about the axes 29 parallel to the axes 28 and will be described in detail below. Near to the outer ends of the arms 27 there are provided, on the side remote from the lining 3, vibrators 32 which induce the tools 30 to execute a hammering action on the inner circumferential surface 4 of the lining. The swinging of the arms 27 about the axes 28 during the introduction of the apparatus into the ladle 1 and the subsequent compliant pressing of the arms 27, or the tools 30, against the inner circumferential surface 4, takes place by means of hydraulic piston/cylinder units 34, which extend outward substantially in the swivel plane of the arms 27 from a bearing position in the vicinity of the carrier tube 15 and act approximately in the center of the arms 27 to push the latter outward.

Figure 3:
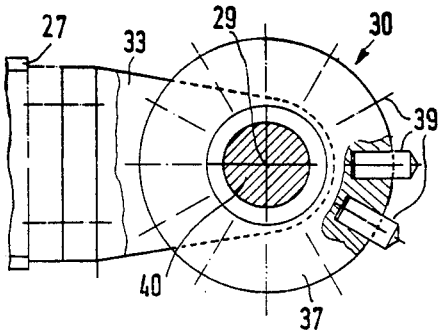
FIG. 3 is a side view of the front end of an arm with the tool partially in section along the line III—III in FIG. 4.
Figure 4:
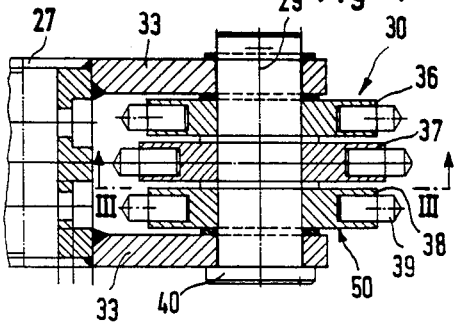
FIG. 4 is a view according to FIG. 3 from above, partially in section.

The tools 30 are shown in FIGS. 3 and 4. At the outer ends of the arms 27, fork-shaped bearing blocks 33 are attached, between the legs of which a disk arrangement 50 of three disks 36, 37, 38 is arranged on a cross pin 40, forming the axis 29. The disks in each case bear 12 radially arrange crushing elements 39 in the shape of studs 39 flatly pointed like chisels around their periphery, which project with the tip beyond the periphery of the disks 36, 37, 38. The disks 36, 37, 38 are freely rotatable on the pin 40. The middle disk 37 is a few millimeters larger in its diameter than the two equally sized neighboring disks 36, 38. The tool 30 does not have to be made up of individual disks. A single disk may also be used which is provided with several rows of crushing elements 39 around its periphery, as is indicated in the case of the tool 30 in FIG. 1.

Figure 2:
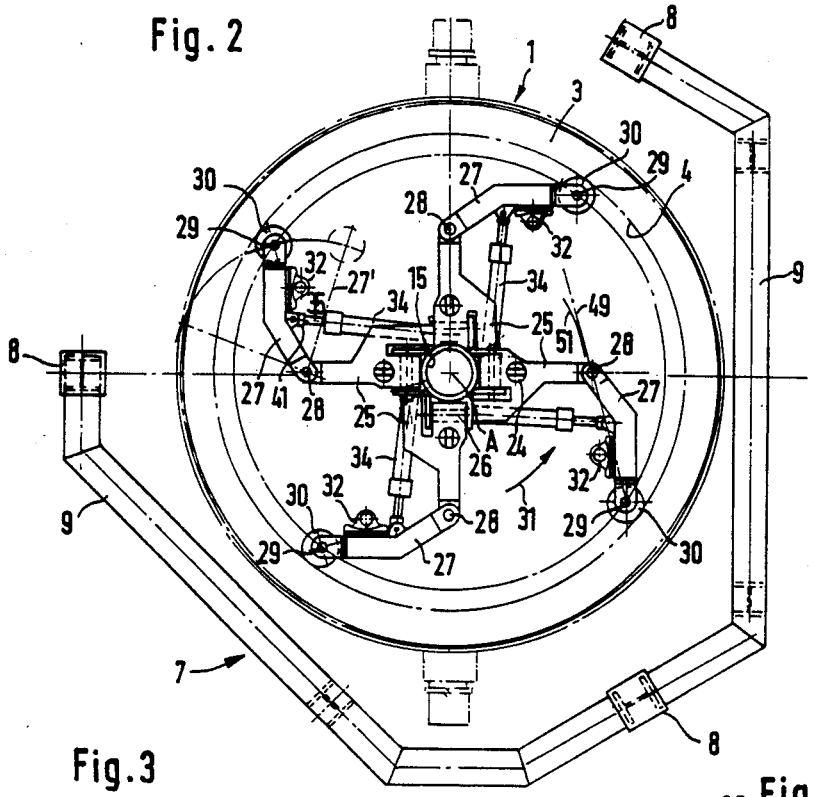
FIG. 2 is a section taken along the line II—II in FIG. 1.
Figure 5:
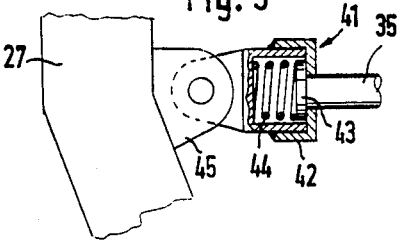
FIG. 5 is a view of a damping element partially in section.
Figure 6:
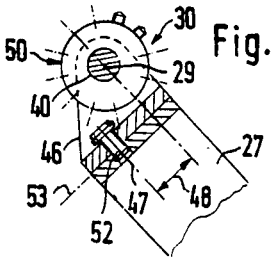
FIG. 6 is a view of a doubly rotatably mounted tool.

In FIG. 5, a damping element 41 is represented, the point of attachment of which is specified by the corresponding reference numeral at the arm 27 furthest to the left according to FIG. 2. The piston/cylinder unit 34, which presses the arm 27 against the inner circumference 4 of the lining, exerts its force via the damping element 41, which comprises a substantially cylindrical housing 42, into which the piston rod 35 displaceably engages. Inside the housing 42, the piston rod 35 has a kind of pressure plate 43, which acts against a helical compression spring 44, which bears against the bottom of the housing 42. The housing 42 is mounted on a bearing eye 45 on the arm 27. When there is a pressure on the piston rod 35, this force is passed on with compression of the spring 44. The arm 27 readily follows the relief of the inner circumference 4 of the lining 3, the spring 44 having a balancing effect. A further function of the spring 44 is that it suppresses and moderates the transfer of the vibrations of the vibrator 32 onto th piston/cylinder unit 34 and thus onto the carrier 20. While in the case of the exemplary embodiment of FIGS. 2 to 4, the tool is rotatable only about the axis 29 with respect to the end of the arm 27, FIG. 6 shows a further-developed embodiment in which the disk arrangement 50 forming the tool 30 is rotatable about the pin 40 in a bearing block 46 which for its part can be swivelled about a pin 52 with respect to the end of the arm 27. The swiveling takes place in a plane 53 which is perpendicular to the swivel plane of the arm 27 and is likewise substantially perpendicular to the longitudinal extent of the arm 27. The axis 47 of the swiveling of the bearing block 46 leaves a transverse distance 48 from the axis of rotation 29 of the disk arrangement 50, so that the bearing block 46 acts with the disk arrangement 50 like a guide roller and can adjust itself automatically to the unevennesses of the circumferential surface 4 of the lining 3. This is intended to avoid the tool 30 catching on unfavorably shaped places of the circumferential surface 4 and tearing out excessively large pieces from the circumferential surface 4.

In the initial position shown in solid lines in FIG. 1 the holding pieces 25 and the arms 27 are in a horizontal plane above the upper rim of the ladle 1. By corresponding operation of the piston/cylinder unit 34, the arms 27 are then swung in, as is indicated at 27' in FIG. 2, so that the tools 30 are completely inside the inner surface 4. The carrier 20 is then lowered, and the holding pieces 25 are swung into the downward pointing position 25'. The lowering is performed until the tools 30 touch the bottom of the lining 3. After switching-on the vibrators, the tools 30 are pressed by the piston/cylinder units 34 against the bottom, and the carrier 20 is slowly rotated by the hydraulic motor 16. As a result, a hammering action is exerted on the inner surface 4 in the bottom area, which action leads to a crushing of the no longer usable layers close to the surface of the refractory lining 3. The holding pieces 25 are then slowly swung outward, as a result of which areas of the bottom located further out radially are worked. For the upright part of the inner surface 4, the holding pieces 25 are brought into the horizontal position, as is indicated by dot-dashed lines inside the ladle 1. The carrier 20 rotates slowly about the axis A, the arms 27 being pressed compliantly against the inner surface 4 via the damping elements 41 and the tools 30 removing the surface, following the contours, down to a substantially constant depth. The work expediently takes place from bottom to top, in order that the tools 30 do not have to work in large quantities of removed material dropping onto the bottom of the ladle toward the end of the operation. When rotating about the axis A, the carrier 20 is slowly moved up.

After removal of the no longer usable surface layers of the refractory lining 3, the ladle 1 is emptied and set down again on the base 5. The guide framework 10 is taken off with the aid of a crane and a corresponding guide framework (not shown) with the mold M on it for the cavity of the ladle 1 is put on in its place, as is schematically indicated in the upper left corner of ladle 1 in FIG. 1. The intermediate space between the mold and the newly created surface 4' of the refractory lining 3 is filled with pourable, refractory material R and this is compacted by vibration, for example by vibrators V acting on the wall of the mold M. The new material bonds with the cleaned surface 4' of the refractory lining to form a new, monolithically continuous lining. The deeper area 3' of the lining 3, adjacent to the container 2, may remain in the ladle 1 over a very long time. To this extent, reference is made to a so-called "permanent" lining.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. An apparatus for restoring a refractory lining of a metallurgical ladle, comprising:

(a) a rotatable carrier, (b) at least one displaceable arm mounted on said carrier; said arm having a free end movable against an inner surface of the lining, (c) means for lowering said carrier into the ladle, (d) means for rotating said carrier about a ladle axis, (e) a lining-removing tool mounted on the free end of said arm, (f) means for vibrating said tool, and (g) means for pressing said lining-removing tool against the lining with a substantially constant force upon rotation of said carrier so that at least a portion of the lining is removed by said tool.

2. Apparatus according to claim 1, wherein said arm is arranged substantially tangential to an imaginary circle around the ladle axis and being towed with respect to the direction of rotation of said carrier.

3. Apparatus according to claim 1, wherein said arm is mounted on a holding piece swingable up and down on said carrier.

4. Apparatus according to claim 1, wherein said arm is displaceable under the action of a relay.

5. Apparatus according to claim 3, wherein said holding piece is displaceable under the action of a relay.

6. Apparatus according to claim 5, wherein said relay is a linear actuator.

7. Apparatus according to claim 4, wherein said relay includes a piston and a cylinder.

8. Apparatus according to claim 4, including a resilient damping element interposed between said relay and an associated arm.

9. Apparatus according to claim 4, wherein said relay is pneumatically actuated.

10. Apparatus according to claim 4, wherein said relay is hydraulically actuated.

11. Apparatus according to claim 5, wherein said relay is pneumatically actuated.

12. Apparatus according to claim 5, wherein said relay is hydraulically actuated.

13. Apparatus according to claim 1, wherein said tool is in the form of a disk arrangement mounted on a free end of said arm and rotatable about an axis substantially aligned with a swivel axis of said arm and fitted with a plurality of crushing elements.

14. Apparatus according to claim 13, wherein said disk arrangement is mounted rotatably in a bearing block capable of swiveling at the end of said arm about an axis disposed in the swivel plane of said arm substantially in the direction of the latter, which latter axis has a transverse distance from the arm axis.

15. Apparatus according to claim 13, wherein said disk arrangement comprises a plurality of disks arranged coaxially next to one another.

16. Apparatus according to claim 13, wherein said crushing elements are flatly pointed studs inserted into the periphery of said disks.

17. Apparatus according to claim 16, wherein a circumferential circle arrangement of the studs includes one of said disks having a slightly larger diameter than adjacent disks.

18. Apparatus according to claim 1, wherein said vibrating means is arranged at the end of said arm adjacent to said tool, on a side of said arm remote from the lining.

19. Apparatus according to claim 1, including means for raising and lowering said carrier on a vertical guide.

20. Apparatus according to claim 1, wherein said carrier has an elongated design and has a plurality of mutually parallel guide surfaces running in a longitudinal direction around its outer periphery, on which surfaces a plurality of fixed-mounted guide rollers roll.

21. Apparatus according to claim 1, including a coaxial carrier tube rotatably mounted in said carrier, against which tube a rotary drive acts and which tube bears at its lower end a plurality of holding pieces and a plurality of said arms.

22. Apparatus according to claim 21, wherein a plurality of holding arms overhang laterally from the lower end of said carrier tube, above said holding pieces, at the ends of which arms a plurality of relays move the holding pieces up and down.

23. Apparatus according to claim 19, wherein said vertical guide is provided on a guide framework supported laterally outside the ladle.

24. Apparatus according to claim 1, including a mold determining a ladle cavity and capable of being introduced into the ladle and means for introducing pourable, refractory material into an intermediate space between the mold and a surface of the old lining and means for compacting material, a stand provided around a base of the ladle, on which stand both a guide framework and a mounting for the mold can be attached.

25. A process of restoring a refractory lining of a metallurgical ladle, comprising:

(a) lowering, on a vertical guide, a carrier with an arm-mounted lining-removing tool thereon into the ladle, said tool being formed with a disk arrangement having a plurality of crushing elements thereon, (b) rotating the carrier in the ladle about a ladle axis, (c) vibrating the tool, (d) pressing the tool against the lining with a substantially constant force upon rotation of the carrier, and (e) rotating the disk about an axis substantially aligned with said ladle axis and a swivel axis of the arm.

26. The process of claim 25 including:

(a) subsequently introducing a mold determining the ladle cavity into the ladle, (b) filling an intermediate space between the mold and ladle with a pourable refractory material.

27. The process of claim 26 including:

compacting the refractory material, wherein the rest of the old lining permanently remaining in the ladle to form a monolithic lining.

28. The process of claim 27 wherein the compacting step is performed by vibrating and bonding the refractory material to the old lining.

* * * * *